US006165118A

United States Patent [19]

Eckert

[11] Patent Number: 6,165,118

[45] Date of Patent: Dec. 26, 2000

[54] FOLDING APPARATUS

[75] Inventor: Günther Oskar Eckert, Zellingen, Germany

[73] Assignee: Koenig & Bauer Aktiengesellschaft, Wurzburg, Germany

[21] Appl. No.: 09/284,949

[22] PCT Filed: Oct. 24, 1997

[86] PCT No.: PCT/DE97/02474

§ 371 Date: Apr. 26, 1999

§ 102(e) Date: Apr. 26, 1999

[87] PCT Pub. No.: WO98/18705

PCT Pub. Date: May 7, 1998

[30] Foreign Application Priority Data

Oct. 25, 1996 [DE] Germany ..... 196 44 393

[51] Int. Cl.[7] ..... B31F 1/08; B31F 1/10

[52] U.S. Cl. ..... 493/425; 493/426; 493/428; 493/434; 493/442

[58] Field of Search ..... 493/425, 426, 493/428, 434, 442

[56] References Cited

U.S. PATENT DOCUMENTS

| | | | |
|---|---|---|---|
| 2,950,105 | 8/1960 | Berry | 493/425 |
| 3,263,988 | 8/1966 | Heimlicher . | |
| 3,865,361 | 2/1975 | Neal . | |
| 4,218,052 | 8/1980 | Noren | 493/425 |
| 4,545,782 | 10/1985 | Niemiro et al. | 493/425 |
| 4,790,804 | 12/1988 | Gotou et al. | 493/426 |
| 5,527,256 | 6/1996 | Vauchelle et al. . | |
| 5,637,072 | 6/1997 | Michaelis | 493/425 |
| 5,924,970 | 7/1999 | Wingate | 493/425 |

FOREIGN PATENT DOCUMENTS

| | | |
|---|---|---|
| 0649741 A1 | 8/1994 | European Pat. Off. . |
| 1076712 | 3/1960 | Germany . |
| 1810294 | 10/1969 | Germany . |
| 195 30 956 A1 | 5/1996 | Germany . |

*Primary Examiner*—Eugene Kim
*Attorney, Agent, or Firm*—Jones, Tullar & Cooper PC

[57] ABSTRACT

A folding apparatus in a rotary printing press utilizes a cutting blade cylinder, a transport cylinder and a folding jaw cylinder. Operation of the various assemblies on the transport cylinder, such as folding blades and gripper systems is accomplished by control cams and associated cam rollers. The control cams are carried on the transport cylinder and rotate in the direction of the transport cylinder and at a speed which is different from the speed of rotation of the cylinder itself. This ensures low wear of the control cams and of the cam rollers.

3 Claims, 3 Drawing Sheets

FOLDING APPARATUS

FIELD OF THE INVENTION

The present invention relates to a cylinder for a folding apparatus. The cylinder carries controlled gripper systems and folding blade systems. These gripper systems and folding blade systems are operated by control cams which rotate in the same direction as the cylinder, and which are attached to each other.

DESCRIPTION OF THE PRIOR ART

From Examined, Published German Patent Application DE-AS 10 76 712, a folding apparatus of this general type, with an arrangement for controlling grippers and folding blades, that is located on the collecting cylinder, is known. The signature feeding device and the folding blades are actuated by means of drive shafts, roller levers, and cam rollers connected to them and each rolling on two control cams.

A disadvantage of this folding apparatus is the major expense for mechanical parts, such as gearing, for driving the rotatable control disks of the signature feeding means, and folding blades for collect-run production. Furthermore, major wear occurs at the cam rollers and control cams.

U.S. Pat. No. 3,865,361 describes a folding cylinder with point needle gripper systems and folding blades. The point needle gripper systems are controlled by control cams and cam rollers, and the folding blades are driven by a toothed gearing system.

U.S. Pat. No. 3,263,988 shows a folding cylinder with a variable-diameter jacket face.

SUMMARY OF THE INVENTION

The object of the present invention is to provide a simple, low-wear drive mechanism for controlled assemblies, as they are called, such as folding jaws, sheet grippers, point needles, and so forth on a cylinder of a folding apparatus.

This object is attained according to the invention by the provision of various controlled assemblies that are operated through cain rollers which roll on rotary control cams. These control cams are supported on the cylinder journal and have the same direction of rotation as the cylinder. The various control cams for the several controlled assemblies on the cylinder are connected to one another.

The advantages attainable with the present invention are, in particular, that a simple drive mechanism can be employed that avoids major expense for gearing. Furthermore, the wear of the cam gear for the drive of the signature feeding means and of the folding blades is reduced, because there is a lower relative speed between the control cams and cam rollers. It is possible to recouple to change over from collect-run to non-collect-run production over a relatively wide angular range.

The cylinder makes a simple, low-arm drive mechanism possible for the cam-controlled assemblies, such as controlled folding jaws, grippers, point needles, and so forth.

BRIEF DESCRIPTION OF THE DRAWINGS

A preferred embodiment of the present invention is shown in the drawing and will be described in further detail below.

Shown are

DESCRIPTION OF THE PREFERRED EMBODIMENT

Figure 1:
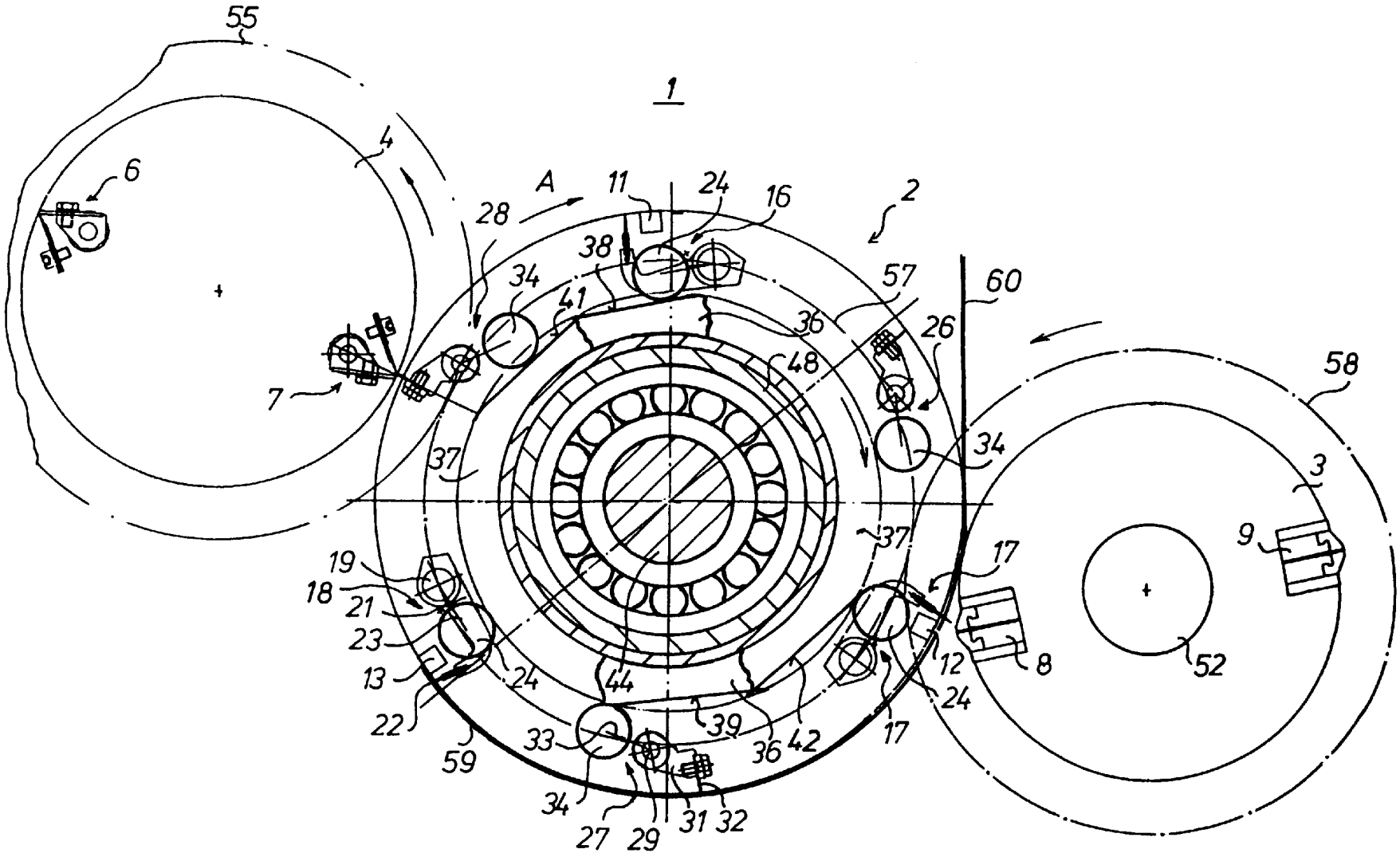
FIG. 1, a schematic illustration of a folding apparatus of the present invention in the "non-collect-run" type of production, in a first operating position.
Figure 2:
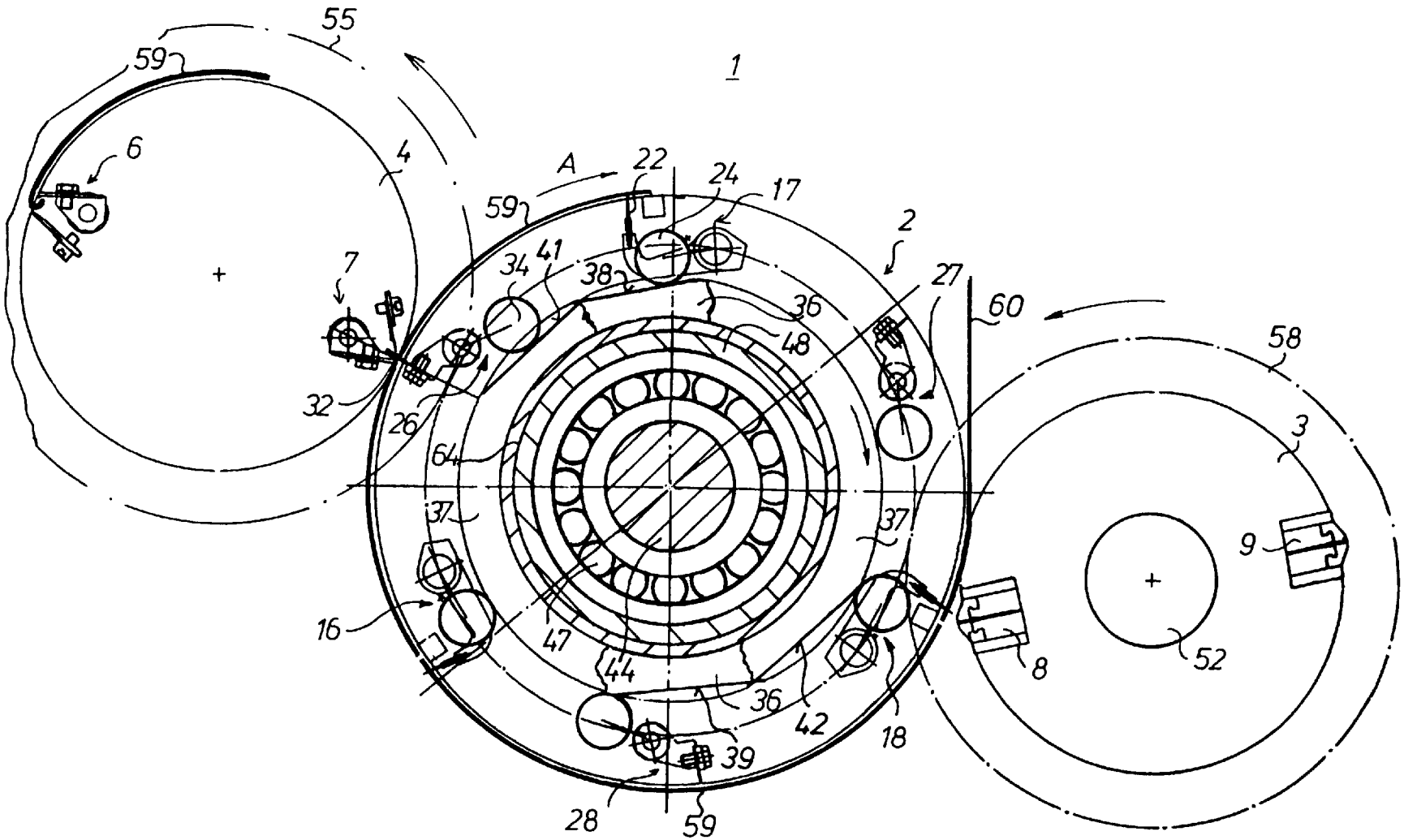
FIG. 2, a view corresponding to FIG. 1, but in a second operating position, in which the collecting cylinder has been rotated onward by 240° and the control cams and the cutting and folding jaw cylinders have been rotated onward by 360°; and in FIG. 3, a plan view on the cutting and collecting cylinder of FIG. 1, showing the control cams and cover disks in the "collect-run" type of production.

A folding apparatus 1 comprises an n-piece, for instance three-piece folding blade and transport cylinder 2 for signatures, and both a cutting cylinder 3, for instance in two parts, and a folding jaw cylinder 4, also for instance in two parts, may be associated with the folding blade and transport cylinder. The folding blade and transport cylinder 2 may be embodied as a collecting cylinder, all as seen in FIGS 1 and 2.

The folding jaw cylinder 4 has two rows of folding jaws 6, 7, offset from one another by 180°, on its circumference.

The cutting cylinder 3 has two cuttings strips 8, 9, offset from one another by 180° on its circumference and including cutting blades.

The cutting strips 8, 9 in turn cooperate with counterpart cutting bars 11, 12, 13, offset from one another by 120° and located on the circumference of the folding blade and transport cylinder 2. There is a row of point needle gripper systems 16, 17, 18 located in the clockwise direction of rotation A of the folding blade and transport cylinder 2, which will hereinafter be called merely the cylinder 2, and located, in each case, in front of or before in the direction of rotation of cylinder 2 the counterpart cutting bar 11, 12, 13. Each point needle gripper system 16, 17, 18 comprises a point needle shaft 19 for form-locking reception of a row of point needle levers 21 with needles 22. Each system 16, 17, 18 also comprises a roller lever 23, which is in form-locking engagement with the point needle shaft 19 and on its free end carries a cam roller 24.

Between the point needle systems 16, 17, 18 and spaced apart from them, an equal number of folding blade systems 26, 27, 28 are disposed, in a known manner, on the circumference of the cylinder 2, offset by 120° from each other. Each folding blade system 26, 27, 28 comprises a folding blade shaft 29 with folding blade holders 31, which hold folding blades 32, and also comprises a roller lever 33, which is secured to the folding blade shaft 29 and on its free end carries a cam roller 34, all as may be seen in FIG. 1.

Figure 3:
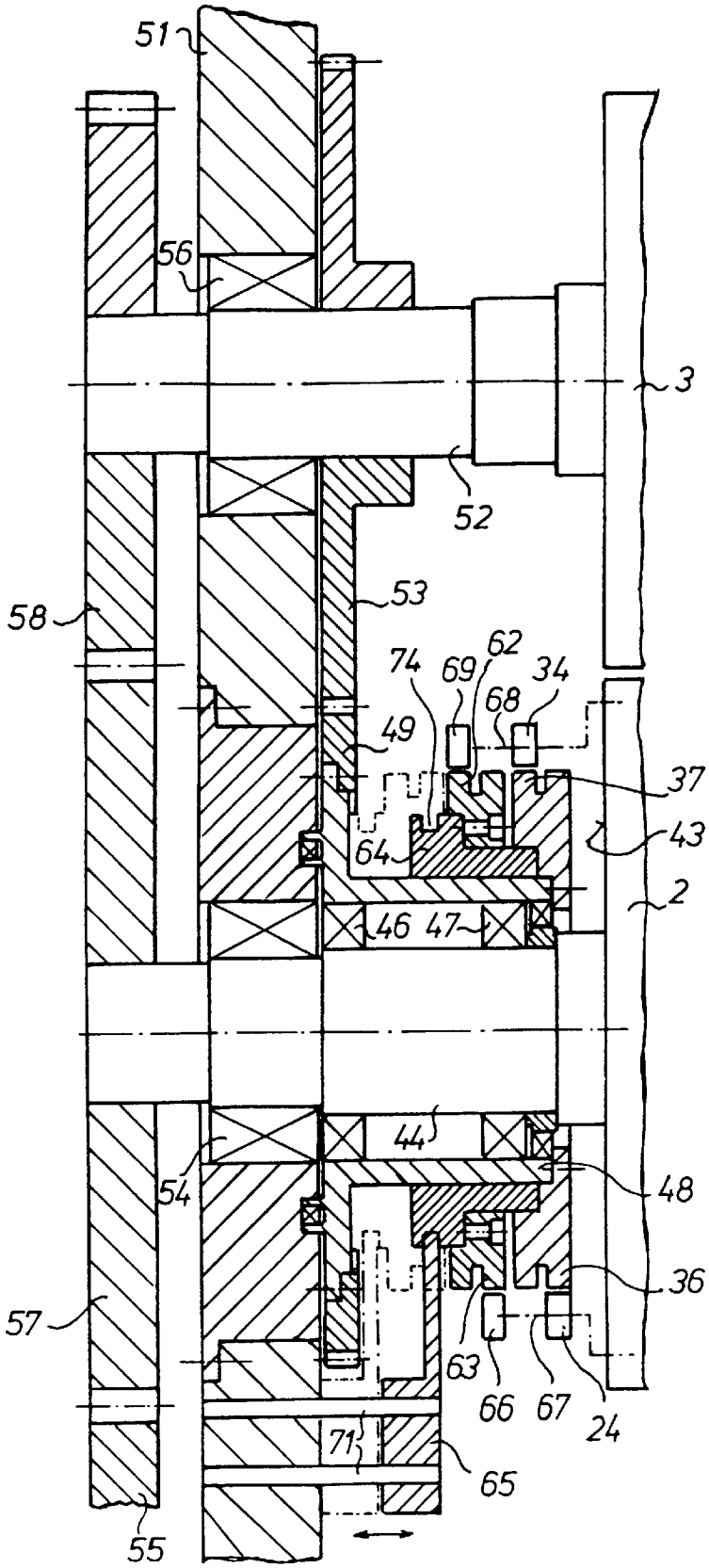

The cam rollers 24 of the point needle gripper systems 16–18 each roll on a control surface of a control cam 36, and the cam rollers 34 of the folding blade systems 26–28 each roll on a control surface of a control cam 37, as shown in FIGS 1–3. Each control cam 36, 37 comprises a disk and on its circumference each control can disk has indexing and nonindexing control surfaces, such as cam troughs 38, 39 and 41, 42, each offset by 180°. Cam troughs 38 and 39 are offset from each other by 180°. Cam troughs 41 and 42 are offset from each other by 180°, all as seen in FIGS. 1 and 2.

Both control cams 36, 37 are connected to one another, for instance by material engagement, as by welding, bonding or the like, and, in the vicinity of a support disk 43, of the cylinder 2 are supported rotatably on a cylinder journal 44 of the cylinder 2. This is accomplished by providing that the control cams 36, 37 are secured to an end face of a first end of a bushinglike control cam carrier 48 that is rotatably disposed on the cylinder journal 44 by means of roller bearings 46, 47. A gear wheel or gear ring 49 is secured in a manner fixed against relative rotation, to the second end of the control cam carrier 48 and it meshes, in the vicinity of a side frame 51, with a gear wheel 53 secured to a cylinder journal 52 of the cutting cylinder 3. A gear ratio of the gear wheels 49, 53 to one another is 1:1, for instance, so that the control cam carrier 48 and thus the control cams 36, 37 are driven at the rotational speed of the cutting cylinder 3. The rotational speed of the control cams 36, 37 corresponds to the number of fields of the folding blade or collecting cylinder 2 (three fields) divided by the number of fields of the folding jaw cylinder 4 (two fields), or in other words is 1.5 times the rotational speed of the folding blade or collecting cylinder 2, as an example.

The cylinder journals 44, 52 of the cylinders 2, 3 are supported in the side frame 51 by means of roller bearings 54, 56, and outside the side frame 51 these cylinder journals 44 and 52 are connected, in a manner fixed against relative rotation, to driving gear wheels 57, 58, respectively. The folding jaw cylinder 4 can be driven by means of a gear wheel 55. The gear wheels 55, 57, 58 are dimensioned such that the rotary speeds of the cylinders to be driven vary in proportion to the number of fields, that is, cylinder 4, which has two fields, cylinder 2 which has four fields and cylinder 3 which has two fields, thus are driven in a ratio of 1.5:1:1.5.

In double-run production, that is, in uncollected production, the control assembly operates as follows:

A signature 59 is located on the folding blade and transport cylinder 2, having been secured on it by the point needle gripper system 18, while the point needle gripper system 17 feeds the beginning 60 of a paper web, as seen in FIG. 1.

After a 240° rotary motion of the transport cylinder 2, the gripper system 17 has fed the beginning 60 of the paper web far enough that the cam roller 24 of the gripper system 17 dips into the cam trough 38 of the control cam 36, which in the meantime, has rotated 360°, and the point needles 22 have been retracted to beneath the surface of the cylinder 2 as depicted in FIG. 2. At the same time, the folding blade system 26, because of the 240° rotary motion of the transport cylinder 2, has reached the folding location opposite the folding jaws 7 and the folding jaw cylinder 4. Because of the rotation of the control cam 37 by 360° in the meantime, the cam roller 34 dips into the cam trough 41 of the control cam 37, so that the folding blade 32 of the folding blade system 26 is actuated and the signature 59 is thus folded again as seen in FIG. 2. The signature 59 is folded in the meantime and is located in the folding jaws 6 of the folding jaw cylinder 4. A further signature 59 is also located on the cylinder 2, as is a new paper web beginning 60. If a collect-run production is to be done with the folding apparatus 1, then cover disks 62, 63, as seen in FIG. 3, are assigned to the control cams 36, 37 on the control cam carrier 48. The cover disk 62 is assigned to the control cam 37 for the folding blade systems 26–28, and the cover disk 63 is assigned to the control cam 36 for the puncture systems 16–18.

The cover disks 62, 63 are circular and have the same diameter as the control cams 36, 37, and each has, for instance, only one cam trough on its circumference. The cover disks 62, 63 are connected to one another and are disposed, in a manner fixed against relative rotation and coaxially, on the control cam carrier 48.

It is also possible for the cover disks 62, 63 to be disposed in a manner fixed against relative rotation on a separate, bushinglike, cover disk carrier 64, but for them to be disposed displaceably in the axial direction on the control cam carrier 48. By means of a suitable displacement device, such as a displacement fork claw 65, which engages a groove 74 extending all the way around the cover disk carrier 64, the cover disk carrier 64 can be displaced both in the direction of the control cams 36, 37 and in the direction of the side frame 51.

Thus the control cams 36, 37 and 62, 63 are displaceably disposed in drivable and rotatable fashion indirectly on the cylinder journal 44. Direct supporting of the control cams 36, 37, 62, 63 on the cylinder journal 44 is also possible.

If the cover disks 62, 63 are displaced in the direction of the control cams 36, 37, then the cover disk 63 for the point needle gripper systems 16–18 comes into communication with a cam roller 66. The cam roller 66 is received by a cam roller axis 67 in the same manner as the cam roller 24. A second cam roller 69 is also disposed on a cam roller axis 68 of the cam roller 34; this cam roller 69 is in communication with the cover disk 62. By means of the synchronous travel of the cam rollers 24, 66 and 34, 69, a particular cam trough of the control cams 36, 37 that is covered by the cover disks 63, 62 is covered, and collecting of the signatures on the cylinder 2 takes place.

The displacement fork 64 can be guided in the side frame 51 by means of a linear guide 71 and can be actuated, for instance with a linear motor, pneumatic work cylinder, or the like. The two terminal positions, "collect-run" or "non-collect-run" of the cover disk carrier 64 can be reported by suitable electrical means, such as end switches or initiators, and stored in memory in the computer.

Because of the slight difference in circumferential speed between the cam rollers 24, 34 mounted on the cylinder 2 and the cam disk 36, 37 rotating in the same direction of the cylinder 2, a long service life of the cam mechanism is achieved. A number of additional drive mechanisms for the cover disks 62, 63 are dispensed with.

It is also possible to provide the cylinder 2 with a different number of fields, for instance where n=5.

In addition, the control cam carrier 48 can be driven via the gear wheel 53 by a gear wheel, not shown, secured to the shaft journal of the folding flap cylinder 4 as well.

While a preferred embodiment of a folding cylinder in accordance with the present invention has been set forth fully and completely hereinabove, it will be apparent to one of skill in the art that a number of changes in, for example, the type of press with which the folding assembly is used, the overall width of the paper web, and the like could be made without departing from the true spirit and scope of the present invention which is accordingly to be limited only by the following claims.

What is claimed is:

1. A folding assembly for a web-fed rotary printing press comprising:

a cylinder, said cylinder supported for rotation by a cylinder journal;

means for rotating said cylinder at a first speed;

a plurality of controlled folding blade systems on said cylinder;

a plurality of controlled gripper systems on said cylinder;

folding blade cam rollers in said folding blade systems;

gripper system cam rollers in said gripper systems;

a folding blade system control cam supported for rotation in a direction of rotation of said cylinder on said cylinder journal said folding blade cam rollers engaging said folding blade system control cam;

a gripper system control cam supported for rotation in a direction of rotation of said cylinder on said cylinder journal, said gripper system cam rollers engaging said gripper system control cam;

means for connecting said folding blade control cam and said gripper system control cam to each other; and means for rotating said connected folding blade control cam and said gripper system control cam together at a second speed, different from said first speed.

2. The folding assembly of claim 1 wherein said control cams are axially displaceable on said cylinder journal.

3. The folding blade assembly of claim 1 further including a control cam carrier for supporting said control cams, said control cam carrier being rotatably supported on said cylinder journal and further including a gear wheel connected to said control cam carrier, said gear wheel being coaxial with said cylinder journal.

* * * * *